United States Patent [19]

Mackenzie

[11] 3,990,288

[45] Nov. 9, 1976

[54] STRETCH-DRAW METAL FORMING

[76] Inventor: Robert A. Mackenzie, 8351 Lucerne Drive, Chagrin Falls, Ohio 44022

[22] Filed: July 10, 1975

[21] Appl. No.: 594,788

[52] U.S. Cl. ..... 72/296; 72/304

[51] Int. Cl.[2] ..... B21D 11/04

[58] Field of Search ..... 72/296, 297, 301, 304

[56] References Cited

UNITED STATES PATENTS

| | | | |
|---|---|---|---|
| 2,676,638 | 4/1954 | Wheeler et al. | 72/296 |
| 3,452,573 | 7/1969 | Mackenzie | 72/296 |
| 3,459,025 | 8/1969 | Bath | 72/296 |
| 3,677,057 | 7/1972 | Mackenzie | 72/296 |

*Primary Examiner*—Lowell A. Larson
*Attorney, Agent, or Firm*—Watts, Hoffmann, Fisher & Heinke Co.

[57] ABSTRACT

Stretch bending or dieing mechanism including a drawing die press having apparatus for tensioning and/or stretching a workpiece, typically in sheet form, at opposite ends of a lower horizontally oriented stationary die. Prior to or in timed relation with the movement of the movable die to form a workpiece having its opposite ends secured in clamp jaws of sheet clamp units of the tensioning and/or stretching apparatus, fluid pressure actuated motors which support the sheet clamp units are actuated to lower the units to stretch and wrap the workpiece partly about the lower die. Simultaneously the units are moved in a predetermined path away from the lower die to tension and/or stretch the workpiece, as desired, by link mechanism having links of different length spaced lengthwise of the path of movement of the movable die. The pivotal connection of the upper links with the clamp units is adjustable to provide different paths of downward travel of the clamp units which allows for greater or lesser stretch of the workpiece and the pivotal connection of the opposite ends of the upper links are movable to allow upward movement of the clamp units in a path different from that followed during their downward movement, which upward path is parallel with the path of movement of the movable die.

Movement of the sheet clamp units in the directions away from the lower die is resisted by the tension in the work sheet during the forming operation. After the forming operation is completed the clamp jaws are opened and the positions of the clamp units relative to the die during their upward movement is controlled by cam means.

The upper workpiece gripping or clamping jaws of the clamp units include further workpiece engaging surfaces on the die sides thereof curved to conform to the crosswise curvature or crown of the lower die which is curved or crowned in two directions, that is, both lengthwise and crosswise so as to uniformly stretch a workpiece to the die.

5 Claims, 14 Drawing Figures

STRETCH-DRAW METAL FORMING

FIELD OF THE INVENTION

This invention relates to sheet forming by use of individual work-gripping, clamps movable relative to a coacting tool or die generally referred to as stretch bending.

PRIOR ART

Sheet forming mechanism using individual work clamp units at opposite ends of a stationary die and movable lengthwise and transversely of the die for tensioning and/or stretching a workpiece, usually a metal sheet, and/or wrapping the workpiece about the die are known. Such mechanisms, however, are objectionable in one way or another, including causing distortion of the formed metal sheet during return of the work clamp units to their loading-unloading position, comparatively expensive operating and adjusting mechanism, and the inability to produce an undistorted finished sheet curved or crowned in two directions with uniform thickness.

SUMMARY OF THE INVENTION

The present invention provides novel and improved sheet forming apparatus of the character referred to capable of being loaded and unloaded by automatic apparatus with their work gripping and stretching assemblies located at opposite ends of a stationary die in an up or raised loading position and movable in readily adjustable predetermined paths to tension and/or stretch and wrap a work sheet partly about the die during the working part of their movement downwardly and which follow different paths during return to their up unloading position.

The invention further provides sheet formng apparatus of the character referred to including work gripping and stretching assemblies having novel and improved work clamps or jaws constructed so that the workpiece will be uniformly stretched and/or thinned during the forming operation to produce metal and plastic panels free of overstretch and excessively thinned material at the crown of such dies. The clamp jaws are constructed to take up the excess metal at the sides of the die, thereby causing the workpiece to be stretched equally at the crown and at the two sides. The equalization of the workpiece stretch produces a more rigid panel free of thin-out at the crown and free of areas of unequal stretch. This in turn allows the user to select materials that could reduce the weight and the cost of producing the finished workpiece.

The above and other features and advantages of the invention will become more apparent as the invention becomes better understood from the herein detailed description of a preferred embodiment of the invention shown in the accompanying drawings.

DETAILED DESCRIPTION OF THE PREFERRED EMBODIMENT

Figure 1:
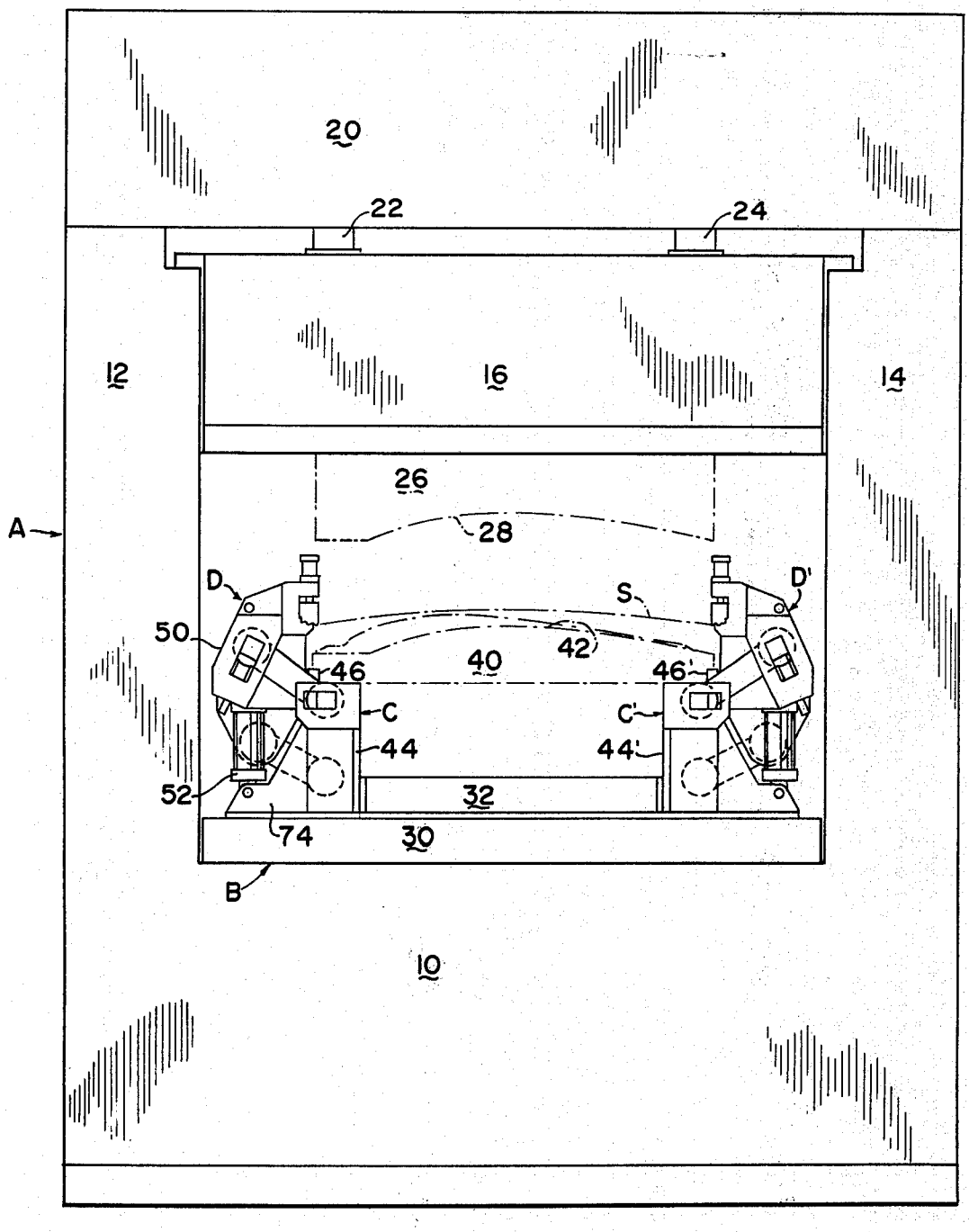
FIG. 1 is a front elevational view of a sheet forming press embodying the present invention.

The invention is shown as incorporated in an upright hydraulic press A having a bed 10 with upright sides 12, 14 provided with guides for a ram 16. The ram 16 is constructed to have a drawing die detachably connected to its under side and is reciprocated by double-acting fluid pressure actuated motors carried by the head 20 of the press and comprising cylinder and piston elements, the piston elements 22, 24 of which are connected to the ram. A typical drawing die is shown in dot-dash line and designated 26. The die has a downwardly facing working face 28. A work tensioning or stretching apparatus B is supported on the press bed 10 between the uprights 12, 14 and comprises a base member 30 upon opposite ends of which are supported sheet gripping and stretching assemblies C, C′. The assemblies C, C′ are spaced from one another on the member 30 by a member 32 also forming part of the work tensioning or stretching apparatus B.

A stationary drawing die 40, shown in dash-dot lines, has an upwardly facing working face 42 which matches and cooperates with the working face 28 of the movable die 26 and is supported on stationary frame members 44, 44′, between die abutment members 46, 46′ fixed on the top of the frame members 44, 44′. Engagement of the abutment members 46, 46′ with opposite ends of the die 40 spaces the upper ends of the members 44, 44′. The dies 26, 40 define when closed a pattern into which a workpiece in the form of a metal sheet S, shown in dot-dash line, is drawn by the dies. The workpiece is tensioned and stretched by the apparatus B prior to and/or during closing of the dies, as desired.

The sheet gripping and stretching assemblies C, C′ at opposite ends of the stationary die 40 are alike and only the left-hand assembly C, as viewed in FIG. 1, will be described in detail. The corresponding parts of the right-hand assembly which appear in the drawings or are herein referred to are designated by the same reference characters as those used for the left-hand assembly but with a prime mark affixed thereto.

Figure 4:
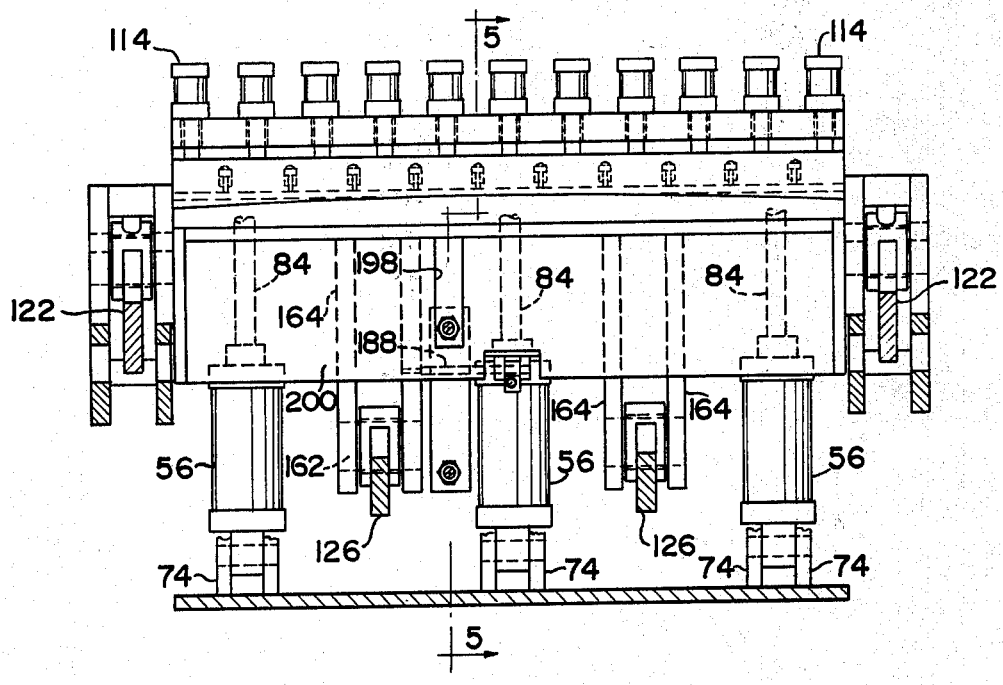
FIG. 4 is a sectional view approximately on the line 4—4 of FIGS. 3 and 5.

The sheet gripping and stretching assembly C includes a sheet clamp unit D comprising a built-up frame assembly 50 supported by three like, double-acting reciprocating type fluid motors 56, see FIG. 4, the cylinder elements of which are pivotally connected by pivot pins 70 to like pairs of plates 74 fixed to the upper side of a generally horizontal base plate 76 forming a part of the frame 44 of the sheet gripping and stretching assembly C. The piston elements 84 of motors 56 are pivotally connected by pivot pins 86 to like pairs of plates 88 of the frame assembly 50 of the gripping or clamping assembly D.

The sheet clamp of grip unit D includes lower and upper jaw or clamp members 100, 102, respectively, extending lengthwise of the left-hand end of the stationary die 40, as viewed in FIG. 1 of the drawings. The lower clamp member 100 is detachably connected to the upper side of a flange 104 facing towards the center of the press formed by a slot 106 in a member 108 forming a part of the frame 50 and extending lengthwise of the end of the die 40. The upper clamp 102 is fixed to the lower side of a member 110 connected to the lower ends of piston rods 112 of a series of like double-acting reciprocating type fluid pressure actuated motors 114, the cylinder elements 116 of which are connected to the upper side of an upper flange 118 of the member 108.

Figure 2:
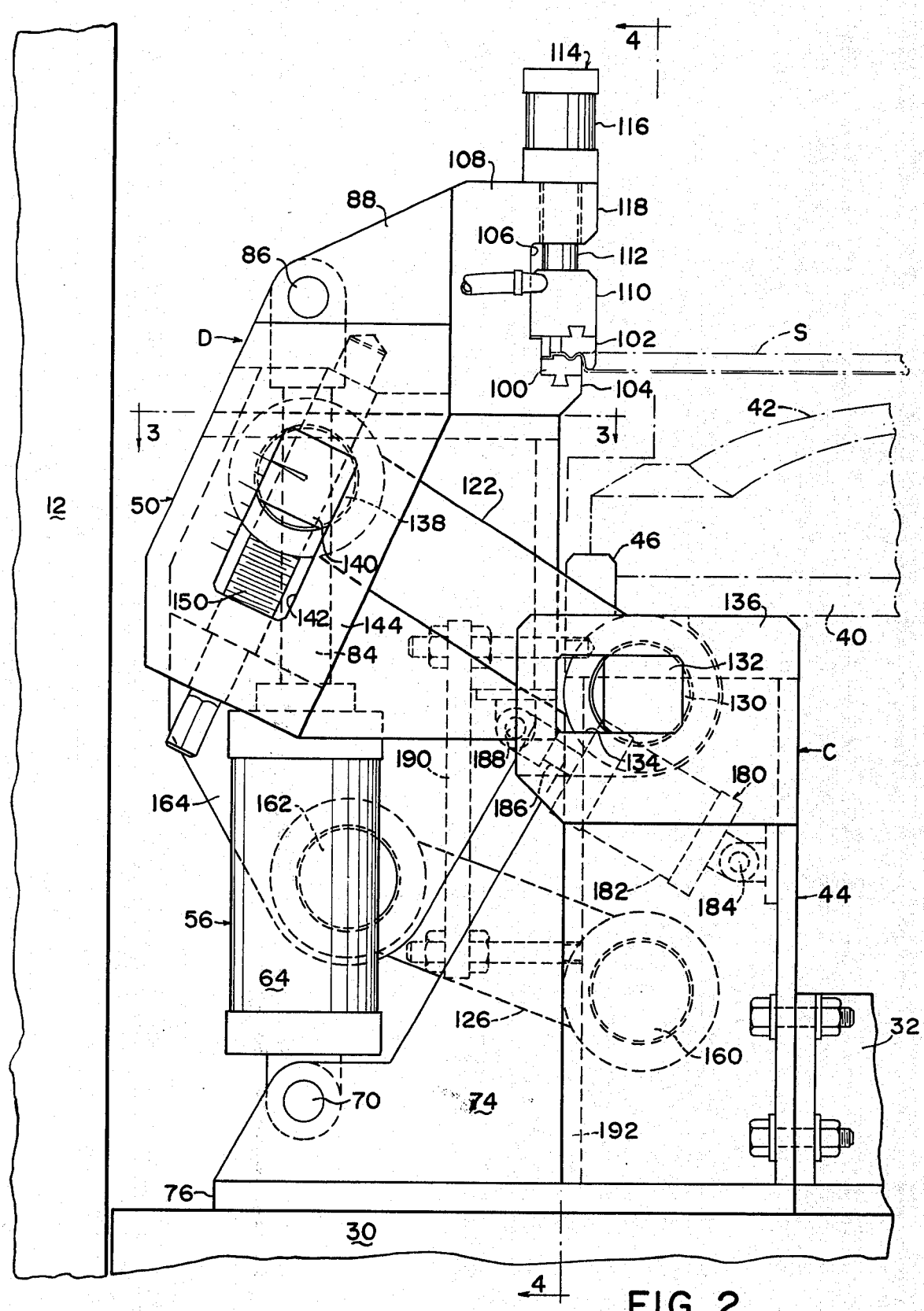
FIG. 2 is a fragmentary enlarged view of a portion of FIG. 1.

The sheet clamp unit D is adapted to be moved lengthwise of the path of relative movement between the movable and stationary dies 26, 40, that is, in the embodiment shown in general vertical direction, by the fluid pressure actuated motors 64. The unit D is guided in its vertical movement and caused to move crosswise away from the path of relative movement between the dies 26, 40, that is, in the direction away from the die 40, by mechanism including link members 122 at opposite ends of the unit and like link members 126 intermediate the ends of the unit. The link members 122 are at a higher elevation than the link members 126 and are longer than the link members 126. The right-hand end of each link member 122, as viewed in FIG. 2 is pivotally connected to a pivot pin 130 connected to a pair of members 132 slidably supported in slots 134 in plates 136 forming a part of the frame assembly 44. The opposite or left-hand end of each link member is pivotally connected to a pivot pin 138 connected to two members 140 slidably supported in suitable guide slots 142 in pairs of end plates 144 of the frame assembly 50. The members 140 which carry the pivot pins 138 are adjustable in the slots 142 by screws 150 rotatably supported in the plates 144 against axial movement relative thereto and having threaded engagement with members 140. The guide slots 134 are generally horizontal and the slots 142 are at an angle to the horizontal preferably as near normal as possible to the length of the links 122, having in mind the fact that the links pivot about their connection to the frame 50 of the gripping and stretching assembly as it is lowered and raised by the motors 56. The purpose is to produce minimum movement of the clamp unit D by the act of adjusting the members 140 in the slots 142.

The right-hand ends of the links, as viewed in FIG. 2, are pivotally connected to pivot pins 160 fixed in the frame member 44 and their opposite ends are connected to pivot pins 162 each fixed in a like pair of plates 164 forming part of the frame 50 of the sheet clamp unit D. As previously mentioned, in the embodiment of the invention shown the links 122 are slightly longer than the links 126.

Figure 6:
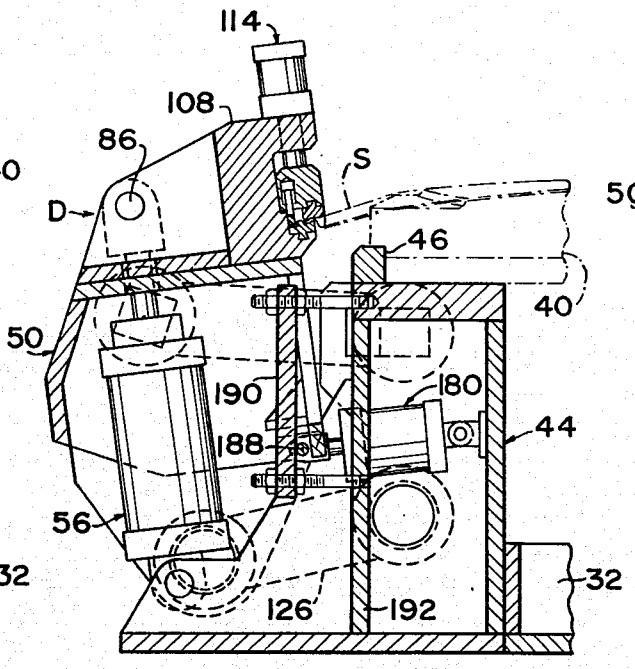

As the sheet clamp unit D is pulled down by the motor 56 the unit D swings about the axes of the pivot pins 130, 160 in the direction to move the upper end of the unit D away from the center of the press because of the difference in the lengths of the upper and lower link members 122, 126. This causes tension or stretch in the workpiece S and forces the members 132 tightly against the right-hand ends of the slots 134. The positions occupied by the various parts of the clamp unit D when in its down position are illustrated in FIG. 6. The path followed by the pair of clamp members 100, 102 can be varied by changing the position of the members 140 in the slots 142.

Figure 3:
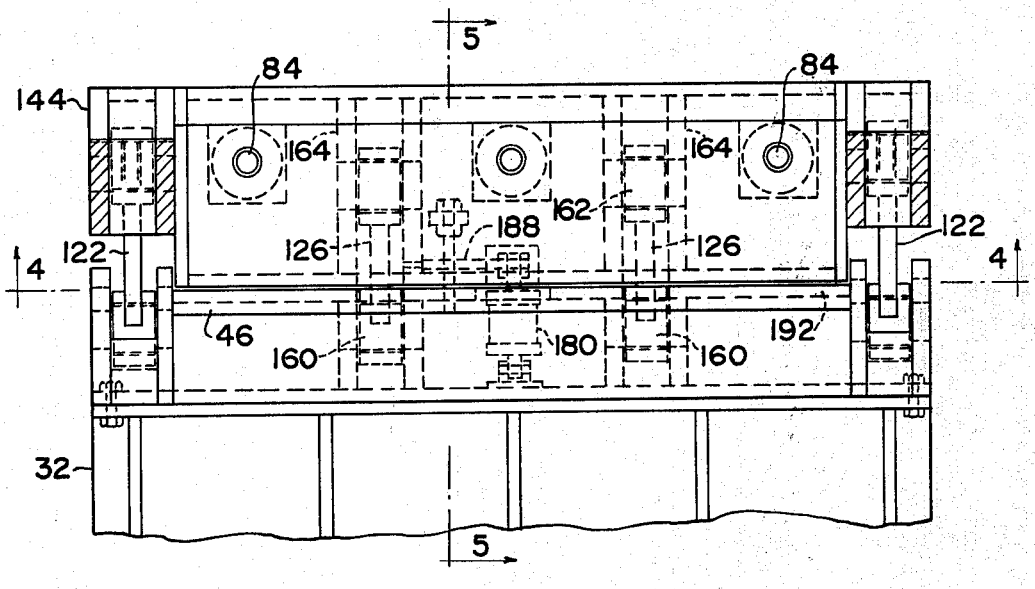
FIG. 3 is a fragmentary sectional view approximately on the line 3—3 of FIG. 2.
Figure 7:
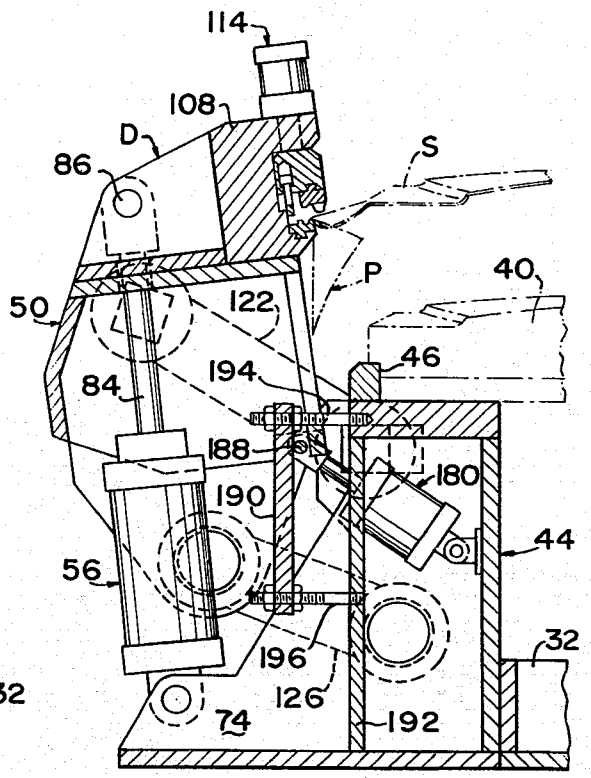
FIGS. 6 and 7 are views similar to FIG. 5 but showing parts in different operating positions.

The press is typically loaded and unloaded by automatic equipment with the clamp units in their up position. When the clamp units reach their down position their clamp jaws are opened and the units preferably caused to follow or travel in a path parallel with the path of relative movement between the dies during their movement in an upwardly direction to unloading position and not the path followed during their travel in the downwardly direction. This avoids the possibility of the drawn or formed workpiece, which is now longer than when loaded into the press, being deformed during movement of the clamp units to unloading position. During return of the clamp unit D by the motors 64 from its down position illustrated in FIG. 6 to the up unloading position illustrated in FIG. 7 it is caused to travel in a path parallel with the path of relative movement between the dies 26, 40 by mechanism including a fluid pressure actuated motor 180 the cylinder element 182 of which is connected by a pivot pin 184 to the stationary frame 44 while the piston element 186 is pivoted by a pivot pin 188 to the frame 50 of the movable clamp unit D. The pivot pin 188 extends a considerable distance to the left as viewed in FIGS. 3 and 4 and during the up movement of the clamp unit D fluid pressure is applied to the motor 180 in the direction to cause the extension of the pivot pin 188 to engage and slide upon the near side of a stationary cam in the form of a straight bar 190 connected to a plate 192 of the frame 44 by stud bolts 194, 196.

Figure 5:
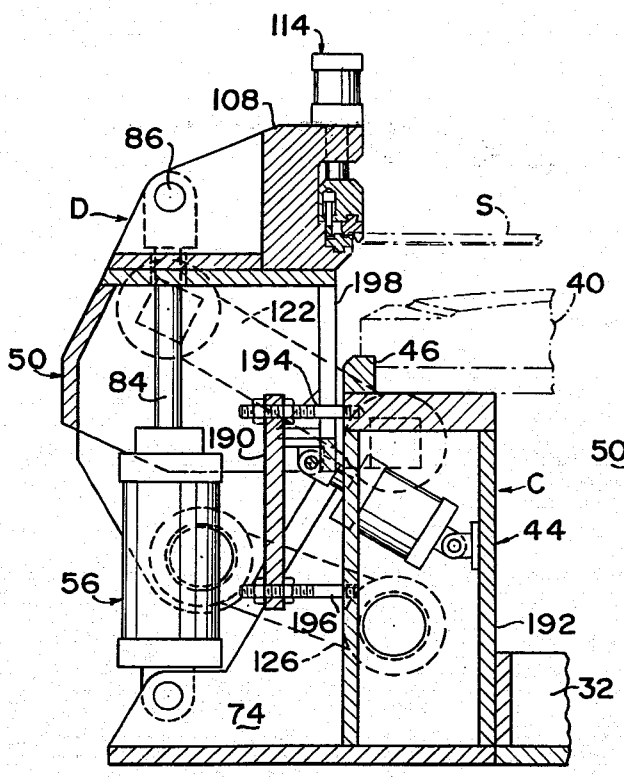
FIG. 5 is a sectional view, with parts in elevation, approximately on the line 5—5 of FIG. 3.
Figures 8, 12, 13, 14:
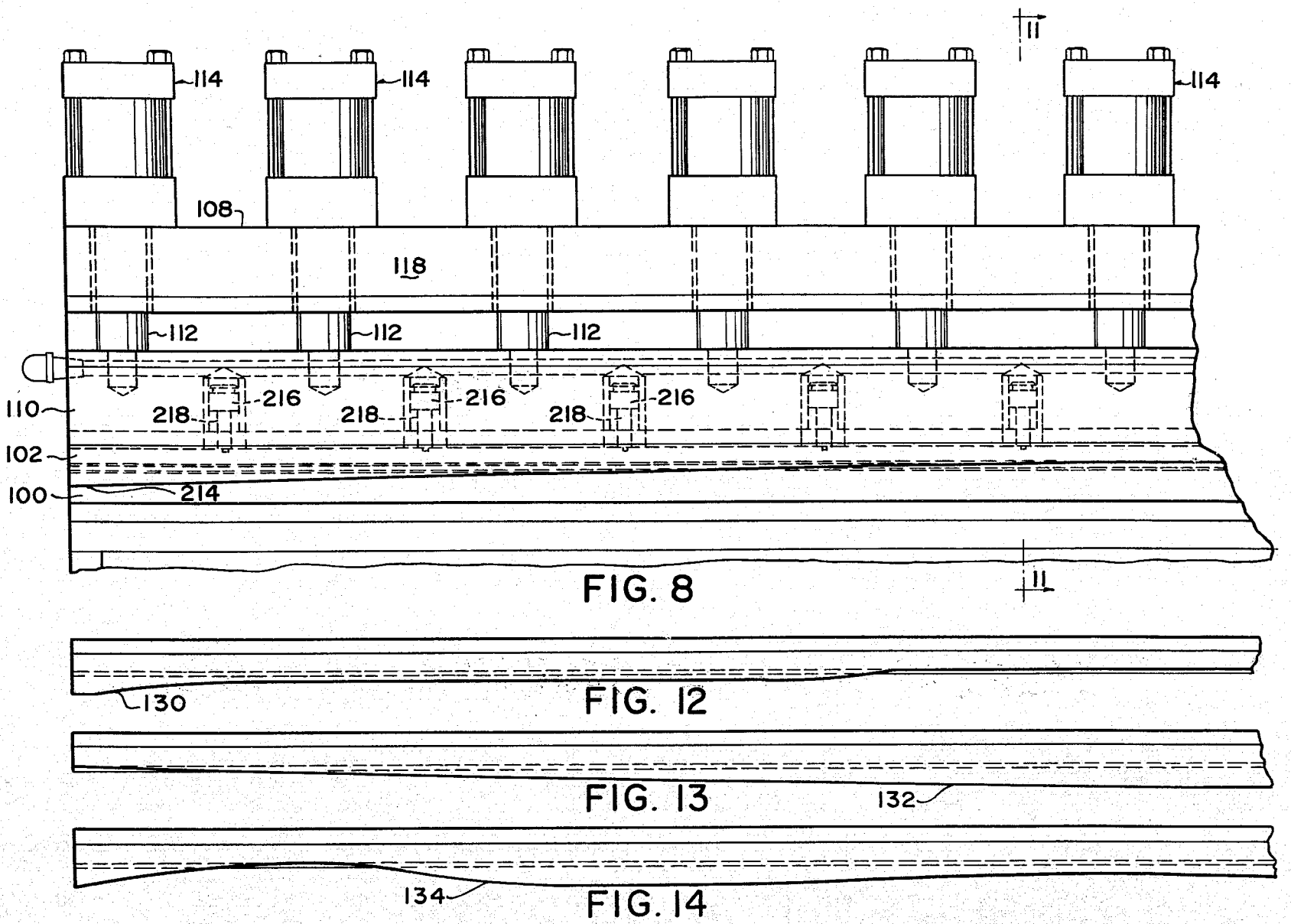
FIG. 8 is a fragmentary enlarged view of the upper left-hand part of FIG. 4.
FIGS. 12, 13 and 14 are elevational views of upper clamp or gripping members or jaws similar to that shown in FIG. 8 but of different construction.
Figure 11:
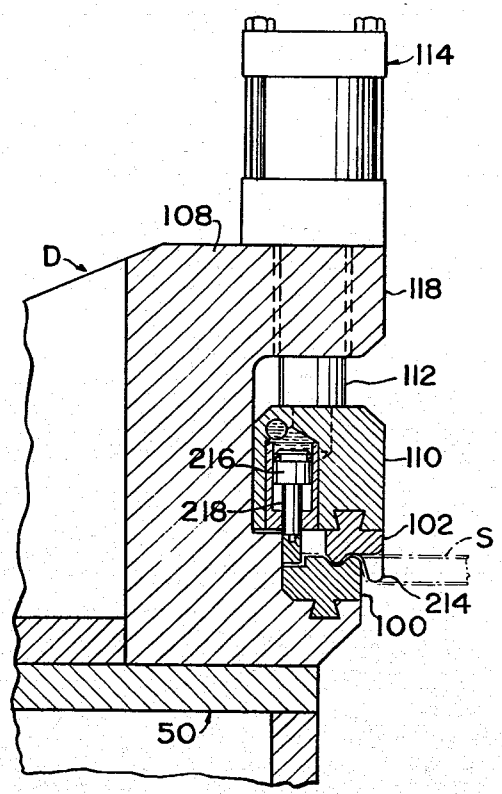
FIGS. 10 and 11 are views similar to FIG. 9 but showing parts in different operating positions.
Figure 10:
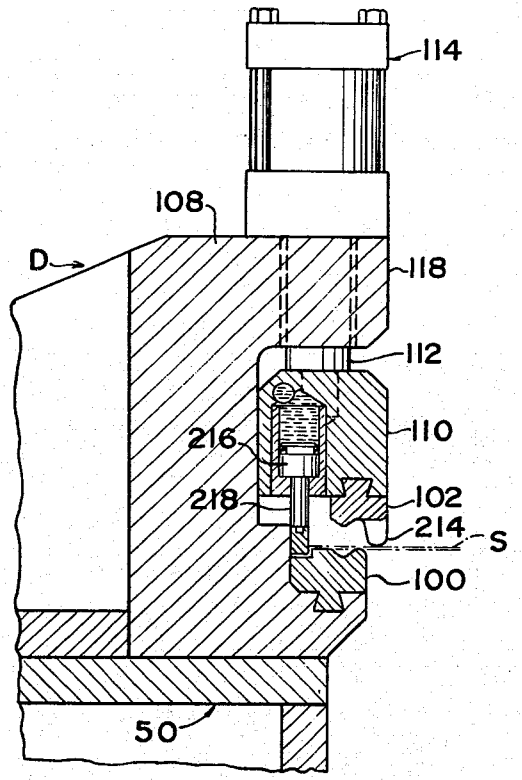
Figure 9:
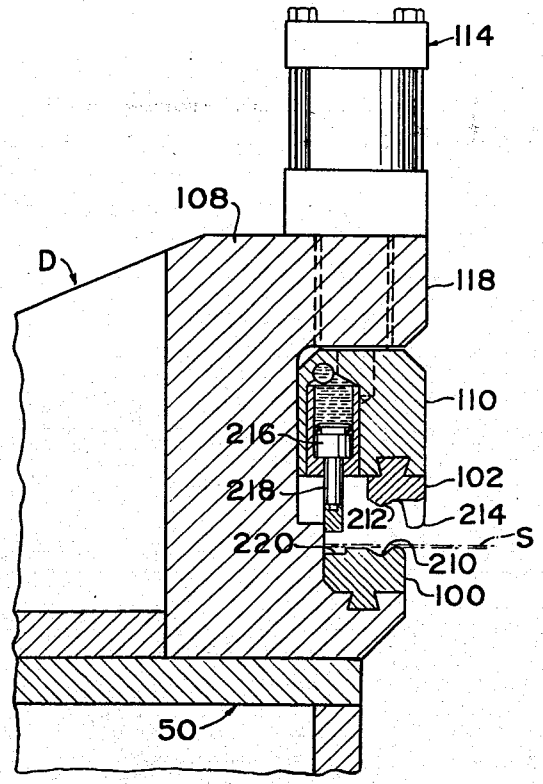
FIG. 9 is a sectional view with parts in elevation approximately on the line 11—11 of FIG. 8.

The member 190 is adjustable to and from the plate 192 by pairs of nuts threaded onto the bolts 194, 196 and abutting opposite sides of the member 190 to accommodate different down positions of the clamp unit D occurring for different positions of the members 140 in the slots 142. The upper bolt 194 extends through a slot 198 in a reinforcing plate 200 of the frame 50. The plate 200 also has an aperture 202 opening into its lower edge to accommodate the piston rod 186. After the clamp unit D reaches its up unloading position, illustrated in FIG. 6 and the workpiece S removed from the press the motor 180 is reversed and the unit D thus returned to loading position shown in FIGS. 1 and 5, but with the clamp jaws 100, 102 open as shown in FIG. 8. A typical path traveled by the upper right-hand edge of the lower workpiece clamp member or jaw 100 during one cycle of press operation is shown in phantom lines in FIG. 7 and designated P. While the cam surface of the cam member 190 engaged by the pivot pin 188 is straight and parallel with the path of relative movement between the dies it is to be understood that this surface may be curved, etc., to produce any desired path for the up movement of the clamp unit D to unloading position.

The right-hand clamp unit D′ as the apparatus is viewed in FIG. 1, as previously indicated, is essentially a mirror image of the unit D and is constructed and operates in a manner similar to unit D. The tensioning and stretching apparatus B of the present invention is quite rugged and relatively inexpensive to manufacture and maintain and is readily adjustable to effect a greater or lesser stretch of the workpiece by simply adjusting in the slots provided therefor, the position of the pivotal connections of the upper links of the link connecting the clamp units D,D′ to the frame members 44, 44′.

The source of fluid pressure and the valves for controlling actuation of the various fluid pressure actuated motors disclosed are not shown or described. Such mechanism is readily available for both manual operation or for automatic operation in predetermined timed relation to the operation of commercially available automatic loading and unloading equipment for presses of the character here involved.

As previously indicated the workpiece gripping or clamping jaws of the clamp units are constructed so that the workpiece will be uniformly stretched and/or tensioned during the forming operation. This is especially advantageous in the production of panels for various parts of automobiles such as hoods, roofs, deck lids, doors and the like, which, with the exception of doors, are typically contoured in two planes, that is, they are crowned in more than one direction. In some instances such products are contoured in other ways as by having recesses or channels formed therein. The dies of the preferred embodiment are constructed to produce a panel crowned both lengthwise of the lower die and also crosswise thereof and the clamp or grip members are constructed to cooperate with the dies to produce a panel of uniform thickness throughout.

Referring particularly to FIGS. 8-11, the clamp or grip member 100 which forms a part of the left-hand workpiece clamp unit D is straight. The upper surface of the member 100 is provided with a lengthwise channel 210 for the reception of a matched rib 212 on the under surface of the upper die 102 to securely clamp the workpiece S when the workpiece clamps or jaws are closed. The upper die 102 has a flange 214 along its lower front side, that is the side adjacent to the lower die 40. The flange 214 is to the outside of the lower die 100 and the flange 214 is arcuate to bow the workpiece S as the dies close and produce a pre-stretch in the side portions of the workpiece.

In order to prevent the end of the workpiece S from being withdrawn from between the clamp members 100, 102 by the action of the flange 214 and the jaws and before the end of the workpiece is securely clamped between the jaw members the part 110 which carries the upper jaw 103 and which may be considered a part of the upper jaw assembly is provided with a series of fluid pressure actuated pistons 216 having downwardly extending plungers 218 of reduced diameter which normally extend towards the lower clamp or jaw 100 a sufficient distance to engage the extreme end of the workpiece S and clamp it tightly against a planar surface 220 of the lower die member 100 about the time the ends of the flange 214 on the die 102 engage the sides of the workpiece S. In the embodiment shown the extreme right-hand end of the workpiece S is bent about a shoulder on the lower die 100 to more securely hold it against movement during the final closing of the clamp or jaw members.

The corresponding clamp or jaw members 100, 102 of the opposite or right-hand clamp unit D are constructed and operate in a similar manner as the clamp or jaw members of the clamp unit D and during forming of the workpiece the workpiece is bent to the configuration of the dies and stretched to a uniform thickness.

The clamp or jaw members of the preferred embodiment are designed for use with dies having a pre-determined pattern but clamp or jaw members constructed in accordance with the present invention may be used with dies having different patterns including dies which are merely crowned lengthwise as panels or workpieces formed by such dies using coventional straight clamp or jaw members tend to neck in or narrow intermediate the ends, which can be overcome by use of clamp or jaw members of the present invention.

Upper die members 224, 226, 228 constructed in accordance with the present invention but designed for use of dies different than the dies of the preferred embodiment are illustrated in FIGS. 12, 13 and 14. The clamp or jaw members shown in FIGS. 12 to 14 are constructed in a manner similar to the upper clamp or jaw member 102 of the preferred embodiment with the exception that the flanges 130, 132 and 134 along the lower front edges thereof are of a different configuration than the flange 214 of the die 102. The particular configurations used are a function of the patterns of the dies with which they are used.

From the foregoing description of the preferred embodiment of the invention it will be apparent that the objections heretofore enumerated and others have been accomplished and that there has been provided stretch-draw metal forming apparatus which in addition to being relatively inexpensive to manufacture and easy to maintain in service has many other novel features.

While a preferred embodiment of the invention has been shown and described in considerable detail the invention is not limited to the construction shown, for example, while the workpiece gripping and stretching assemblies C,C′ at opposite ends of the stationary or lower die 40 are essential mirror images of one another they may be different and merely one may incorporate the present invention, and it is intended to hereby cover all adaptations, modifications and uses of the disclosed constructions which come within the practice of those skilled in the art to which the invention pertains and the scope of the appended claims.

Having thus described my invention, what I claim is:

1. In apparatus for stretch-drawing a metal workpiece, a workpiece clamping and stretching assembly locatable adjacent to one end of a die having a nonplanar work face, said workpiece clamping and stretching assembly including a frame and a workpiece clamp unit or head, means connecting said clamp unit to said frame for movement in opposite directions relative to the die both transversely of the work face of the die and lengthwise of the work face of the die, said means comprising a pair of like links having their one ends pivotally connected to said frame for movement lengthwise of the working face of the die and their opposite ends adjustably connected to said clamp unit or head, and at least one additional link pivotally connected to said frame and to said clamp unit and spaced from said pair of links in the direction towards the opposite side of the die.

2. In apparatus for stretch-drawing a metal workpiece, a workpiece clamping and stretching assembly locatable adjacent to one end of a die having a nonplanar work face, said workpiece clamping and stretching assembly including a frame and a workpiece clamp unit or head having workpiece engaging surfaces extending lengthwise of the adjacent end of the die and movable relative to one another, one of said surfaces being straight, the other of said surfaces having a portion matching said one surface and a portion at the side of said matching surface at least a part of which is contoured lengthwise of the adjacent end of the die, means connecting said clamp unit to said frame for movement in opposite directions relative to the die both transversely of the work face of the die and lengthwise of the work face of the die, said means comprising a pair of like links having their one ends pivotally connected to said frame for movement lengthwise of the working face of the die and their opposite ends adjustably connected to said clamp unit or head, and at least one additional link pivotally connected to said frame and to said clamp unit and spaced from said pair of links in the direction towards the opposite side of the die.

3. In apparatus for stretch-drawing a metal workpiece, a workpiece clamping and stretching assembly locatable adjacent to one end of a die having a nonplanar work face, means supporting said clamp unit for movement in opposite directions relative to the die transversely of the work face of the die and lengthwise of the work face of the die, said clamp unit having workpiece engaging members provided with lineal surfaces facing one another and extending lengthwise of the adjacent end of the die, means for moving one of said members to and from another to selectively clamp a workpiece between said lineal surfaces thereof, said one member having a further workpiece engaging surface thereon at the side of said lineal surface thereof towards the die, a portion of which further surface is contoured lengthwise of the adjacent end of the die, and means at the side of said surfaces on said one member away from the die for clamping a workpiece against said another member in advance of or at about the time of engagement of the workpiece by said further surface on said one member.

4. In apparatus for stretch-drawing a metal workpiece, a workpiece clamping and stretching assembly locatable adjacent to one end of a die having a generally horizontal nonplanar work face, means supporting said clamp unit for movement in opposite directions relative to the die transversely of the work face of the die and lengthwise of the work face of the die, said clamp unit having workpiece engaging members provided with generally horizontal opposed lineal surfaces to extend lengthwise of the adjacent end of the die, means for moving said member having the upper of said opposed lineal surfaces thereon relative to said member having the lower of said opposed lineal surfaces thereon to selectively clamp a workpiece between said surfaces, said member having the upper of said opposed lineal surfaces thereon having a further workpiece engaging surface at the side of said lineal surface thereof the die, a portion of said further surface being contoured lengthwise of the adjacent end of the die and having parts thereon extending below said lineal surface of said member, and means at the side of said surfaces on said member having the upper of said opposed lineal surfaces thereon away from the die for clamping a workpiece against said member having the lower of said lineal surfaces thereon in advance of or at about the time of engagement of the workpiece by said surfaces on said member having the upper of said lineal surfaces thereon.

5. In apparatus for stretch-drawing a metal workpiece, a workpiece clamping and stretching assembly locatable adjacent to one end of a die having a generally horizontal nonplanar work face, means supporting said clamp unit for movement in opposite directions relative to the die transversely of the work face of the die and lengthwise of the work face of the die, said clamp unit having workpiece engaging members provided with generally horizontal opposed lineal surfaces to extend lengthwise of the adjacent end of the die, means for moving said member having the upper of said opposed lineal surfaces thereon relative to said member having the lower of said opposed lineal surfaces thereon to selectively clamp a workpiece between said surfaces, said member having the upper of said opposed lineal surfaces thereon having a further workpiece engaging surface at the side of said lineal surface thereof towards the die, a portion of which further surface is contoured lengthwise of the adjacent end of the die and has parts thereof extending below said lineal surface of said member, and fluid pressure actuated plunger means carried by said member having the upper of said opposed lineal surfaces thereon and located at the side of said surfaces thereon away from the die for selectively clamping a workpiece against said member having the lower of said lineal surfaces thereon in advance of or at about the time of engagement of the workpiece by said surfaces on said member having the upper of said lineal surfaces thereon.

* * * * *

UNITED STATES PATENT AND TRADEMARK OFFICE

CERTIFICATE OF CORRECTION

PATENT NO. : 3,990,288

DATED : November 9, 1976

INVENTOR(S) : Robert A. Mackenzie

It is certified that error appears in the above-identified patent and that said Letters Patent are hereby corrected as shown below:

Column 8, line 4, after "thereof" insert -- towards --

Signed and Sealed this

Fifteenth Day of March 1977

[SEAL]

*Attest:*

RUTH C. MASON
*Attesting Officer*

C. MARSHALL DANN
*Commissioner of Patents and Trademarks*